US009516939B2

(12) United States Patent
Pires et al.

(10) Patent No.: US 9,516,939 B2
(45) Date of Patent: Dec. 13, 2016

(54) COSMETIC APPLICATOR

(71) Applicant: ZEN DESIGN SOLUTIONS LIMITED, Kowloon (HK)

(72) Inventors: Leo Clifford Pires, Basking Ridge, NJ (US); Roger Hwang, Maple (CA); Smita Srivastava, New Delhi (IN); Iti Seth, Faridabad (IN); Rahul Bose, New Delhi (IN)

(73) Assignee: ZEN DESIGN SOLUTIONS LIMITED, Kowloon, Hong Kong (CN)

( * ) Notice: Subject to any disclaimer, the term of this patent is extended or adjusted under 35 U.S.C. 154(b) by 87 days.

(21) Appl. No.: 14/703,374

(22) Filed: May 4, 2015

(65) Prior Publication Data

US 2015/0320177 A1 Nov. 12, 2015

(30) Foreign Application Priority Data

May 9, 2014 (IN) ..... 1262/DEL/2014

(51) Int. Cl.

| | |
|---|---|
| ***A45D 34/04*** | (2006.01) |
| ***A45D 40/26*** | (2006.01) |
| ***A46B 9/02*** | (2006.01) |

(52) U.S. Cl.

CPC ..... *A45D 40/265* (2013.01); *A45D 34/045* (2013.01); *A46B 9/021* (2013.01); *A46B 2200/1053* (2013.01)

(58) Field of Classification Search

CPC .. A45D 34/045; A45D 34/046; A45D 40/265; A45D 40/267; A46B 9/021

USPC ..... 401/121, 122, 123, 124, 126, 127, 129,401/130

See application file for complete search history.

(56) References Cited

U.S. PATENT DOCUMENTS

| | | | | |
|---|---|---|---|---|
| 4,428,388 | A * | 1/1984 | Cassai | A46B 9/021 132/218 |
| 6,053,179 | A * | 4/2000 | Lhuisset | A45D 40/262 132/142 |
| 6,309,125 | B1 * | 10/2001 | Peters | A46B 11/0006 401/126 |
| 7,469,702 | B2 * | 12/2008 | Kim | A46B 3/18 132/120 |
| 7,665,473 | B1 | 2/2010 | Gueret | |

* cited by examiner

*Primary Examiner* — David Walczak
*Assistant Examiner* — Joshua Wiljanen
(74) *Attorney, Agent, or Firm* — Patterson+Sheridan, LLP

(57) ABSTRACT

A cosmetic applicator is provided. The cosmetic applicator includes a flexible application member which is manufactured independently in a first shape. The cosmetic applicator includes a stem which is a cylindrical hollow body configured to receive the application member. The application member is configured to attain a second shape when constrained within the stem. The application member includes an elongated base member and an applicator head attached to a first side of the base member.

20 Claims, 10 Drawing Sheets

COSMETIC APPLICATOR

CROSS-REFERENCE TO RELATED APPLICATION

This application claims benefit of Indian Provisional Application Ser. No. 1262/DEL/2014, filed May 9, 2014, which is incorporated by reference in its entirety.

BACKGROUND

Field of the Invention

Embodiments of the present disclosure generally relate to a cosmetic applicator for applying a cosmetic product to a keratinous fiber. More particularly, the present disclosure relates to a cosmetic applicator having a flexible application member which has a first shape when manufactured and is configured to attain a second shape when assembled within the cosmetic applicator. The cosmetic or care products include viscous cosmetics such as mascara, eye liner, lip gloss, hair color and like products.

Description of the Related Art

Numerous kinds of cosmetic and care products are available in the market today. Some such cosmetic products include mascara, lip gloss, eye liner or the like products which are fluidic in nature.

Applicators for applying these cosmetic products are known to be either molded or twisted. Conventionally, such applicators include a stem, at one end of which is connected an applicator head. The other end of the stem is provided with a handle for gripping. Cosmetic applicator such as a mascara applicator deposits and distributes the product i.e. the mascara all over the lashes. As mascara, is a product that is difficult to apply because of the sensitive target area of application, it is desirable that no clumping of product occurs and the lashes are separated and combed evenly. However, all the desired effects are not possible with a single mascara brush. This is because the eyelashes are soft, flexible, delicate and in close proximity to very sensitive eye tissue. Further, a user may require twisting and/or turning his/her hands in a particular manner to achieve a particular desired effect, such as curling on the lashes and not all users are adept in being able to gradually twist their wrist along with the outward stroke of application on the lashes.

U.S. Pat. No. 7,665,473 relates to a comb for applying a product on keratinous fibers. The comb includes an arrangement of teeth for applying said product. The arrangement of teeth is obtained by assembling at least two separate parts. The patent also relates to an application set equipped with such comb, and its use for applying make-up on eyelashes or eyebrows.

However, there is still much scope for having a single applicator which would provide both of the improved application of the cosmetic product to the eyelashes and desired effects such as curling of the eyelash. Also, it is desired to have an applicator which is easy to manufacture and cost effective at the same time.

SUMMARY

According to an embodiment of the present disclosure, a cosmetic applicator is provided. The cosmetic applicator includes a flexible application member which is manufactured independently in a first shape. Further, the cosmetic applicator includes a stem which is a cylindrical hollow body configured to receive the application member. The application member is configured to attain a second shape when constrained within the stem. In an embodiment of the present disclosure, the application member includes an elongated base member and an applicator head attached to a first side of the base member. According to an embodiment, the applicator head is manufactured curved in shape and is configured to attain a substantially straight shape when placed within the stem.

Further, according to an embodiment of the present disclosure, the application member includes a means for holding and discharging cosmetic product, provided on one side of the applicator head. The means for holding and discharging cosmetic product include a plurality of projecting elements which may include tines, bristles, indentations and flocked surfaces disposed on one side of the applicator head.

In an embodiment of the present disclosure, the application member includes tines disposed on one side of the applicator head. For example, the tines are hook shaped, such that free ends of the tines are hooked towards a single side of a longitudinal axis of the application member. Further, the tines are disposed alternatively on opposite sides of the longitudinal axis of the applicator head. Furthermore, the application member includes a cap provided and integrally molded on a tip of the applicator head.

In an embodiment of the present disclosure, the stem includes a longitudinal opening defining a channel delimited by two longitudinal edges. A length of the longitudinal opening is substantially equal to a height of the applicator head. The application member is removably inserted into the hollow stem via the longitudinal opening such that the applicator head fits into the longitudinal opening and the tines project out there from. Therefore, when the application member is inserted into the stem, the stem acts as a core of the cosmetic applicator to which the tines are attached. In an exemplary embodiment of the present disclosure, a length of the application member is greater than a length of the stem. Therefore, a second end of the base member of the application member is pulled through an opening at a proximal end of the stem to fit the application member in the stem and more particularly the applicator head into the longitudinal opening such that the cap abuts a distal end of the stem.

According to an embodiment of the present disclosure, the stem includes a number of grooves provided on an inner surface of the stem towards the distal end of the stem. Further, the applicator head of the application member includes a number of ribs provided in proximity to the tip of the applicator head. The ribs are configured to align with the grooves on the stem to lock the applicator head and the application member within the stem.

The above and other objects, features and advantages of the present disclosure will become clear from the following description of the preferred embodiments when the same is read in conjunction with the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1:
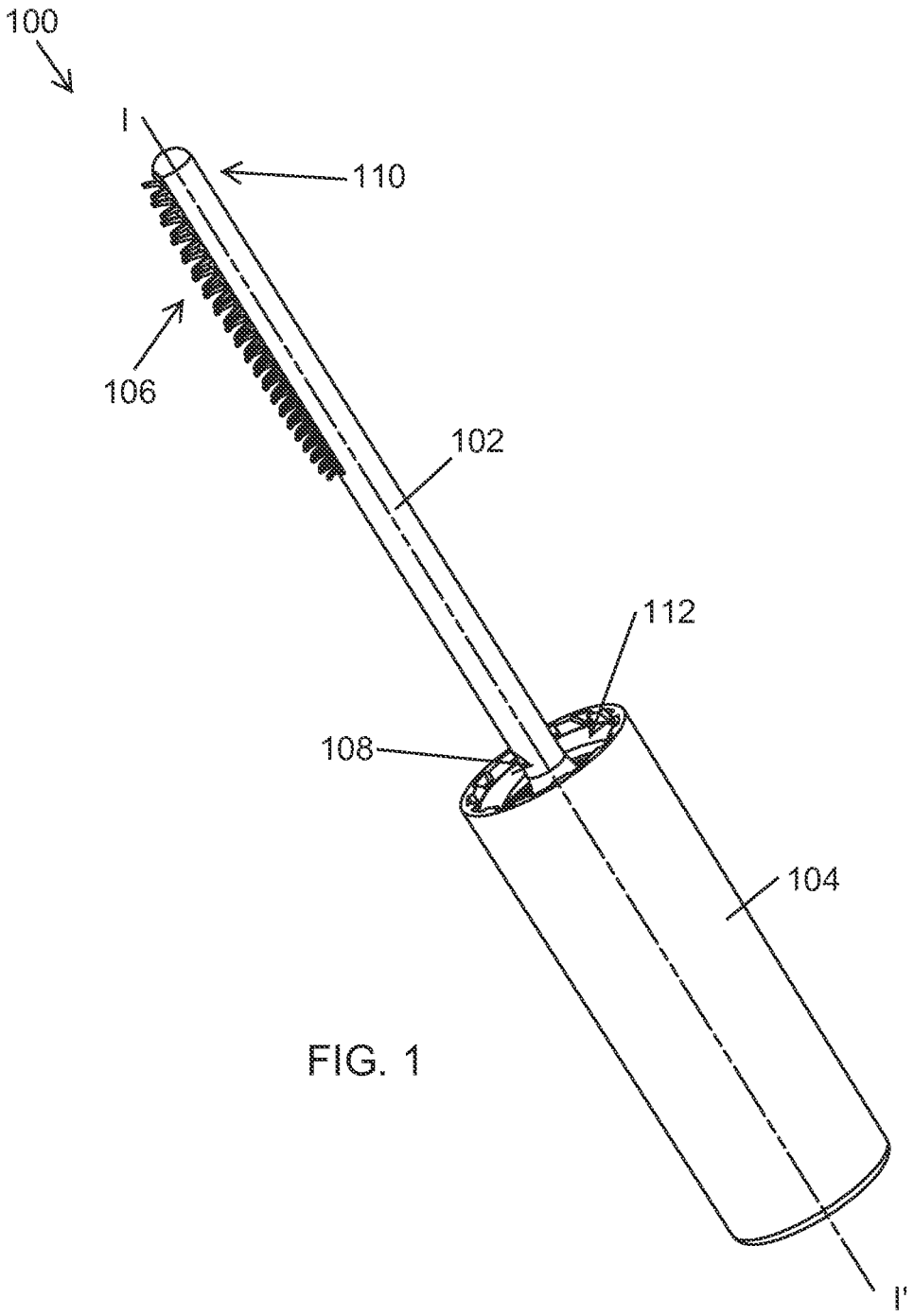
FIG. 1 illustrates an isometric view of a cosmetic applicator, according to an embodiment of the present disclosure.

To facilitate understanding, identical reference numerals have been used, where possible, to designate identical elements that are common to the figures. It is to be noted, however, that the appended drawings illustrate only specific embodiments of the present disclosure and are therefore not to be considered limiting of its scope, for the disclosure may admit to other equally effective embodiments.

DETAILED DESCRIPTION

A cosmetic applicator (100) according to an embodiment of the present disclosure is shown in FIGS. 1 to 6. The cosmetic applicator (100) may be used to apply a cosmetic product to skin and/or keratinous fiber, such as hair. The cosmetic or care product include viscous cosmetics such as mascara, eye liner, lip gloss, hair color and like products. In an exemplary embodiment of the present disclosure, the cosmetic applicator (100) is a mascara applicator for applying mascara to eyelashes and/or eyebrows.

As shown in FIGS. 1 to 4, the cosmetic applicator (100) includes a stem (102), a handle (104) and an application member (106). Further, the cosmetic applicator (100) extends along a longitudinal axis I-I'. In an exemplary embodiment of the present disclosure, the stem (102) may be a substantially rigid member, whereas the application member (106) may be a substantially flexible member of the cosmetic applicator (100). In various alternate embodiments the stem (102) may be a flexible member or a combination of rigid and flexible member. It may be contemplated that some or all parts, i.e., the stem (102), the handle (104) and the application member (106) of the cosmetic applicator (100) may be manufactured separately and may be modularly assembled together to form the cosmetic applicator (100).

Further, the stem (102) has a proximal end (108) and a distal end (110). The handle (104) is attached to the proximal end (108) of the stem (102). The handle (104) is closed at one end and is open at another end, thereby forming a hollow cavity (112) within.

The proximal end (108) of the stem (102) is attached to the handle (104) by a snap fit locking mechanism. In various alternative embodiments, the proximal end (108) of the stem (102) may be attached to the handle (104) by using any other locking mechanism known in the art, such as a threaded mechanism, etc. In a yet another embodiment, the stem (102) and the handle (104) may be molded together as a single component of the cosmetic applicator (100).

The handle (104) includes a first set of threads (114) disposed on an inner surface and towards the open end of the handle (104). The first set of threads (114) are configured to engage with a second set of the threads provided on an outer surface of a receptacle (not shown) of the cosmetic product to detachably attach the handle (104) to the receptacle to form a packaging device for the cosmetic product. In various alternative embodiments, the handle (104) may be engaged with the receptacle by any other engagement means known in the art such as snap fit, j-lock etc.

Figure 4:
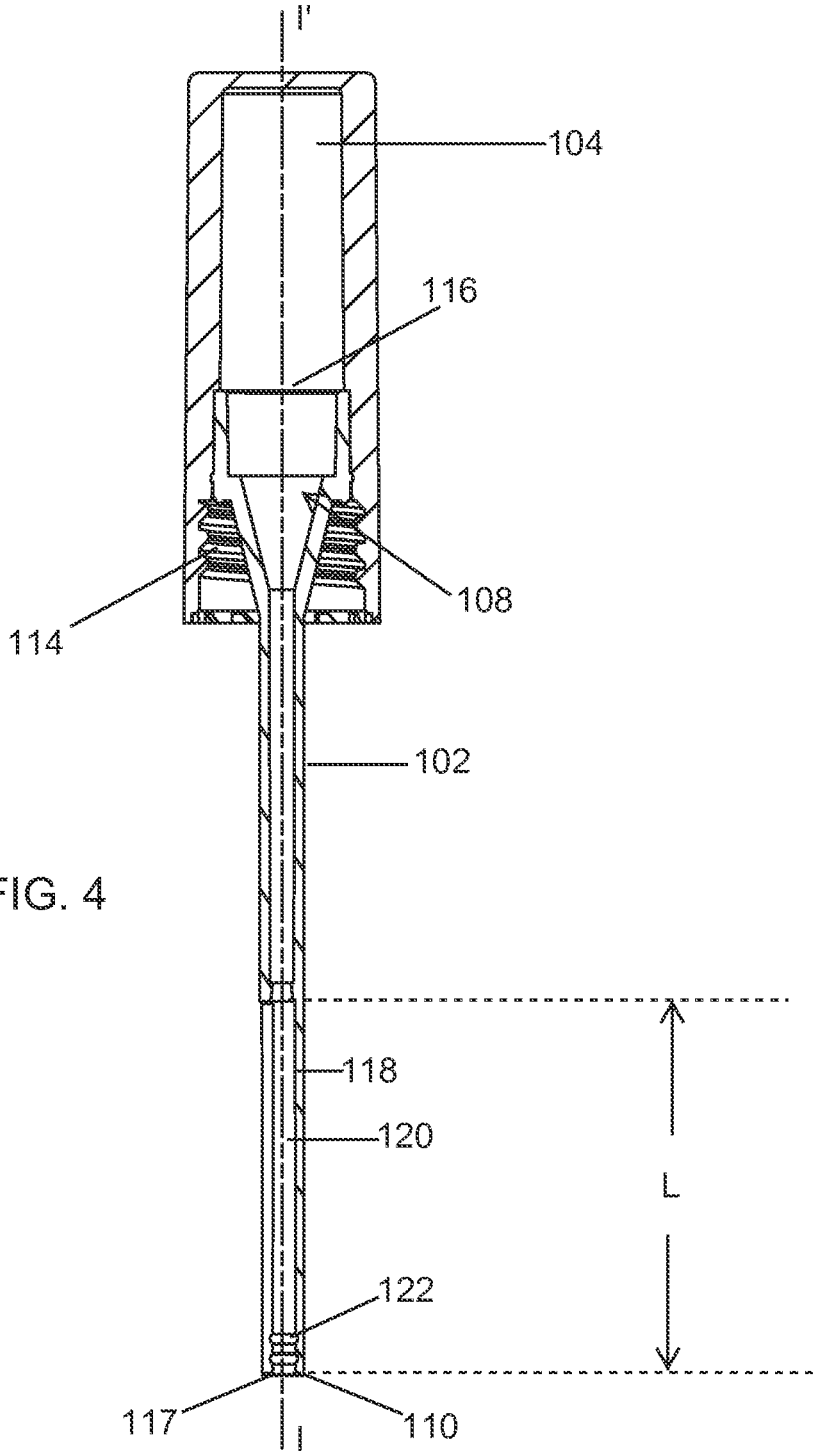
FIG. 4 illustrates a cross-sectional view taken along axis A-A of the stem and the handle of the cosmetic applicator of FIG. 3.

The stem (102) is an elongated hollow cylindrical body having openings at the proximal end (108) and the distal end (110). In an exemplary embodiment of the present disclosure, opening (116) at the proximal end (108) has an inner diameter larger than an inner diameter of the opening (117) at the distal end (110) of the stem (102). For example, as shown in FIG. 4, a cross-sectional shape of the stem (102) towards the proximal end (108) may be conical in shape such that the opening (116) at the proximal end (108) has a larger inner diameter than the inner diameter of the opening (117) at the distal end (110). It may be contemplated that the cross-sectional shape of the stem (102) towards the proximal end (108) is merely exemplary and may be varied to achieve similar results without limiting the scope of the claimed subject matter.

Figure 3:
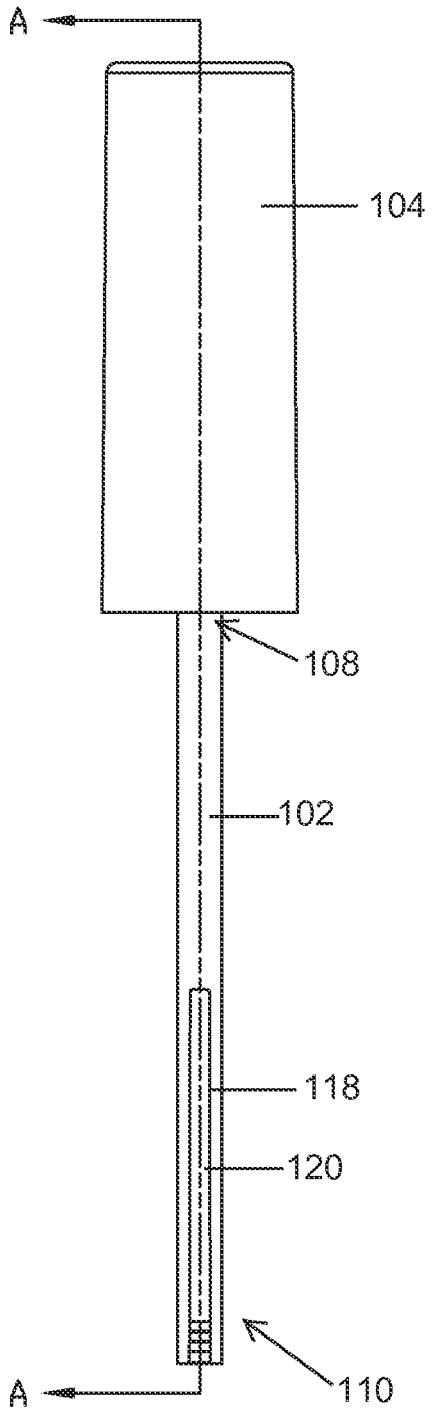
FIG. 3 illustrates a front view of a stem and handle of the cosmetic applicator of FIG. 1.

In an embodiment, the stem (102) includes a longitudinal opening (118) disposed on one side of the stem (102) and towards the distal end (110) of the stem (102). For example, the longitudinal opening (118) extends up to a mid portion of the stem (102), and has a length L. It may be contemplated that the length L of the longitudinal opening (118) or the extent to which the longitudinal opening (118) extends is exemplary and may be varied as desired without deviating from the scope of the claimed subject matter. As shown in FIGS. 3 and 4, the longitudinal opening (118) is configured to form a channel (120) delimited by two longitudinal edges. Further, the channel (120) merges with the hollow cavity of the stem (102). Furthermore, the longitudinal opening (118) includes a number of grooves (122) provided towards the distal end (110) of the stem (102) and on an inner surface of the stem (102).

Figures 5, 6:
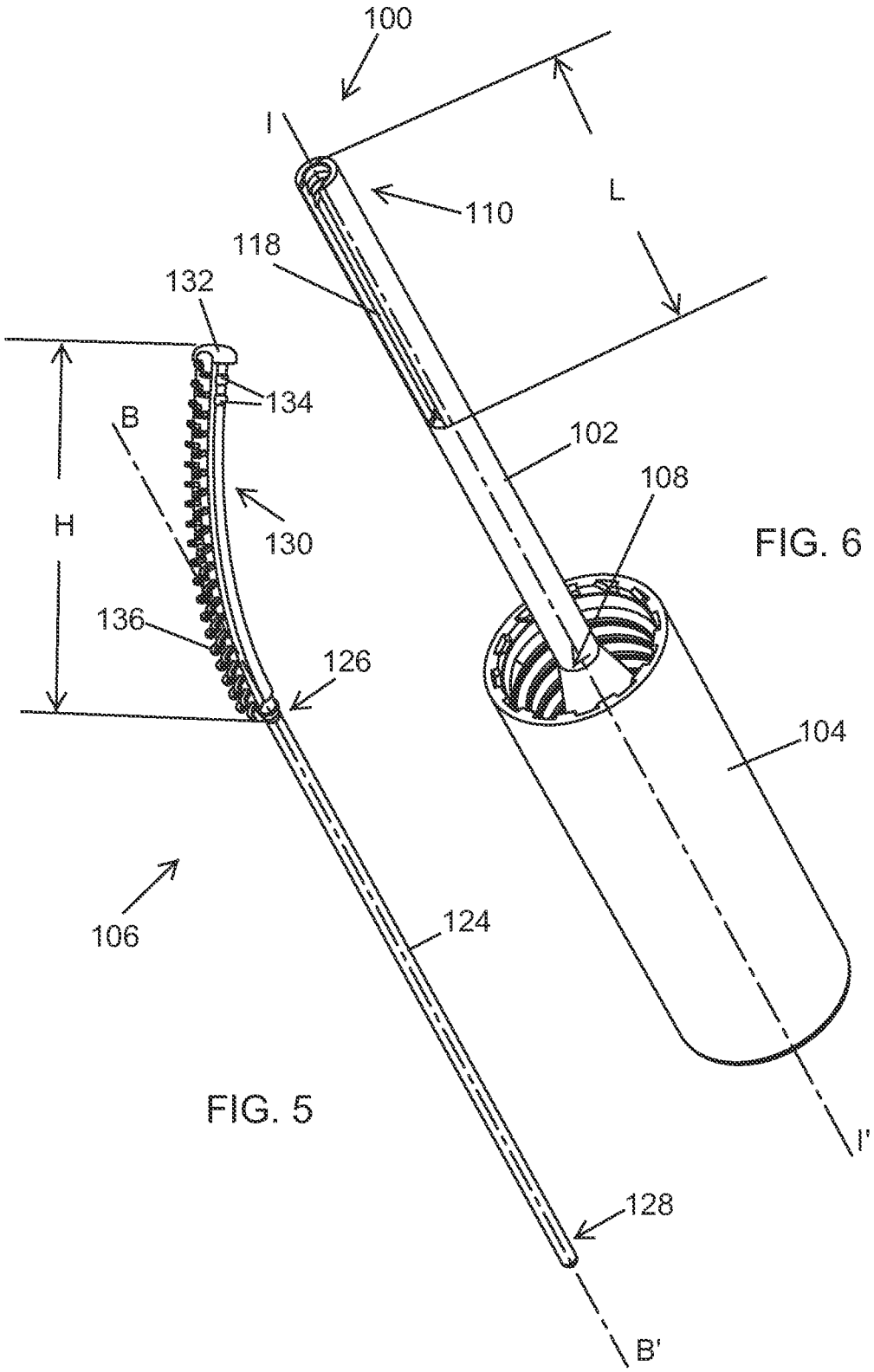
FIG. 5 illustrates a perspective view of an application member of the cosmetic applicator of FIG. 1.
FIG. 6 illustrates an isometric view of the stem and the handle of the cosmetic applicator of FIG. 1.

Referring to FIG. 5, an isometric view of the application member (106) is shown in isolation. As explained previously, the application member (106) is a substantially flexible member of the cosmetic applicator (100). In an exemplary embodiment of the present disclosure, the application member (106) is capable of changing its shape from a first shape to a second shape when constrained within a covering of second shape. For example, the application member (106) is made up of plastic. The application member (106) may be capable of getting back to the first shape when removed or freed from the covering having the second shape. In an alternative embodiment, the application member (106) may be made of any malleable material, such as a malleable metal so that the base member (124) may or may not be permanently deformed into the second shape when constrained within the covering of the second shape, which in this case is the stem (102) having a substantially straight profile.

The application member (106) includes an elongated base member (124) having a first end (126) and a second end (128). The application member (106) further includes an applicator head (130) attached to the first end (126) of the base member (124). In an exemplary embodiment of the present disclosure, the applicator head (130) has a larger outer diameter than an outer diameter of the base member (124). Furthermore, a height H of the applicator head (130) is substantially equal to the length L of the longitudinal opening (118) of the stem (102). The applicator head (130) is integrally formed with the base member (124) to form the application member (106). In an embodiment of the present disclosure, the applicator head (130) is curved in shape during manufacturing, as shown in FIG. 5. As explained previously, the applicator head (130) is substantially flexible, and it is manufactured in the first shape, which in this case is the curved shape. The applicator head (130) is curved such that the tip of the applicator head (130) is bended away from a longitudinal axis B-B' of the application member (106), as shown in FIG. 5.

Furthermore, the applicator head (130) includes a cap (132) provided at a tip of the applicator head (130). In an example, the cap (132) may be integrally formed with the applicator head (130). It may be contemplated that the cap (132) may also be formed separately as an individual component and be assembled with the applicator head (130) during assembling process of the cosmetic applicator (100). In an exemplary embodiment of the present disclosure, a cross section of the cap (132) is substantially similar to a cross-section of the stem (102). Furthermore, the application member (106) includes a number of ribs (134) provided in proximity to the cap (132). The ribs (134) are configured to align with the grooves (122) as shown in FIG. 4 on the stem (102) to lock the application member (106) in the stem (102). In an exemplary embodiment of the present disclosure, the ribs (134) are configured to snap fit the application member (106) within the stem (102).

Furthermore, the application member (106) includes a means for holding and discharging cosmetic product, on one side of the applicator head (130). The means for holding and discharging cosmetic product include a plurality of projecting elements which may include tines, bristles, indentations and flocked surfaces disposed on one side of the applicator head (130). In present embodiment, the means for holding and discharging cosmetic product includes a number of tines (136) disposed on the applicator head (130). In an exemplary embodiment, the tines (136) are disposed only on one side of the applicator head (130). In various other embodiments, the tines (136) may be disposed on all sides of the applicator head (130). The tines (136) are integrally molded on the applicator head (130). In an exemplary embodiment, the tines (136) are made of the same material as that of the applicator head (130) and the base member (124), such as plastic, with less thickness. However, in various other embodiments, the material of the applicator head (130) and the base member (124) may be different than the material of the tines (136), such as when the applicator head (130) and the base member (124) are made up of metal and the tines (136) are made up of plastic or any other soft material, so that the tines (136) are soft in order to provide soft contact with the eyelash or eyebrows, etc., to which the cosmetic product is applied. In alternate embodiments, the applicator head (130) and the base member (124) may be made of a flexible material like any polymeric material and the tines (136) may be made up of a hard material like metal, alloy, ceramic etc which may have cooling or heating properties.

Figures 7A, 7B:
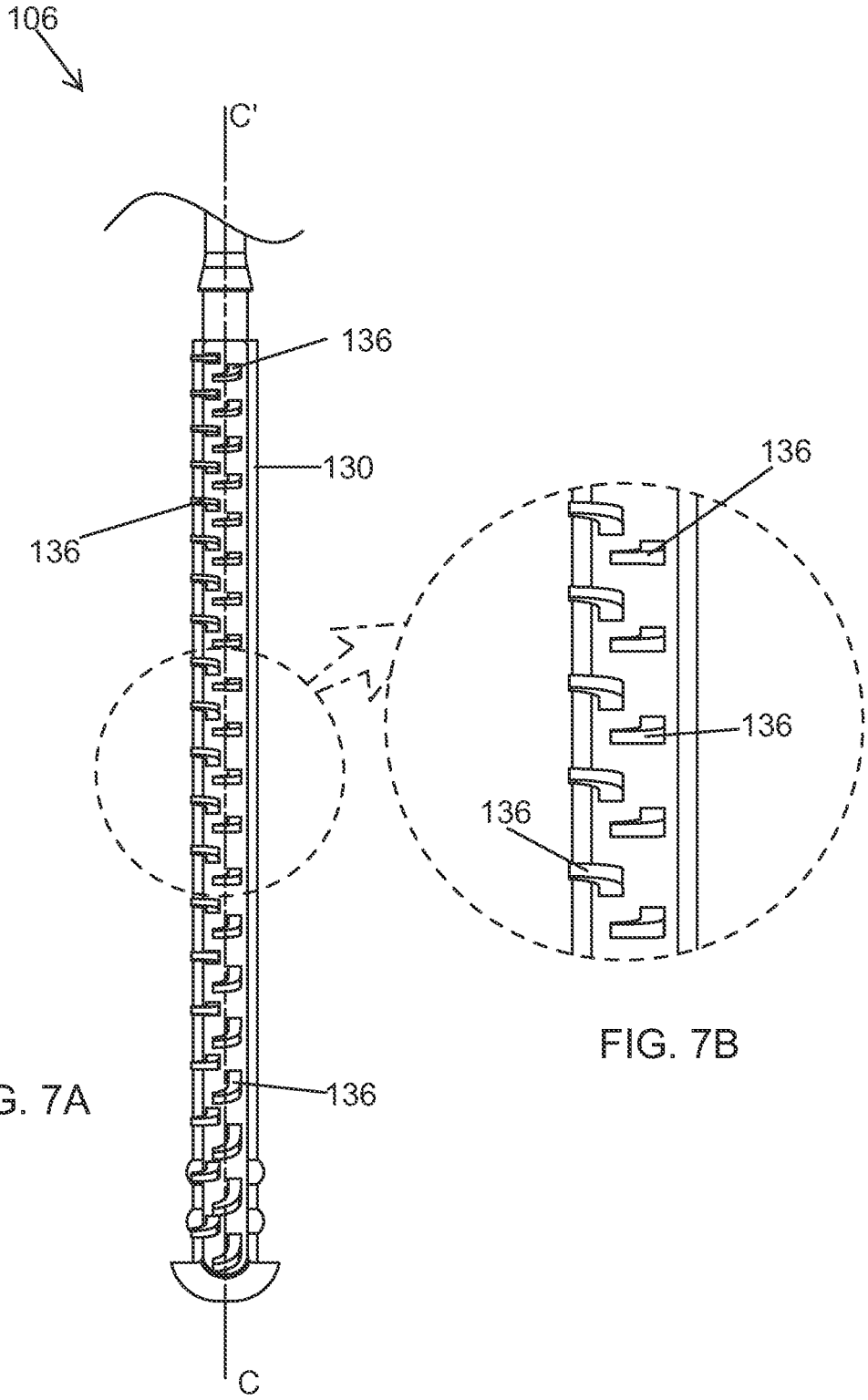
FIG. 7A illustrates a perspective view of an applicator head of the application member of FIG. 5.
FIG. 7B illustrates an enlarged view of a portion of the applicator head of FIG. 7A.

FIGS. 7A and 7B illustrate a perspective view and an enlarged view respectively of the applicator head (130) and the tines (136). As shown in FIGS. 7A and 7B, the tines (136) are disposed in an alternative manner on opposite sides of a longitudinal axis C-C' of the applicator head (130). In an exemplary embodiment of the present disclosure, the tines (136) are hook shaped, such that the free ends of all the tines (136) are hooked towards a single side of the longitudinal axis C-C'.

Referring to FIGS. 5 and 6, during manufacturing, the applicator head (130) is curved to maintain a predetermined distance between the free ends of the tines (136), in order to provide an ease of manufacturing of the tines (136). The predetermined distance between the free ends of the tines (136) may be based on a number of parameters, such as the material of the tines (136), the thickness of the tines (136), a desired number of tines (136) that need to be provided on the applicator head (130), etc. Furthermore, an angle of curvature of the curved shape of the applicator head (130) may also be based on the desired predetermined distance between the free ends of the tines (136).

Referring back to FIGS. 4 to 6, during assembling of the cosmetic applicator (100), the application member (106) is removably inserted into the longitudinal opening (118) from the second end (128). In an exemplary embodiment of the present disclosure, a length of the application member (106) is greater than a length of the stem (102). Therefore, for assembling the cosmetic applicator (100), the application member (106) is inserted into the stem (102) and an assembling person may pull the second end (128) of the base member (124) from the opening (116) on the proximal end (108) of the stem (102) to fit the application member (106) into the stem (102).

Figure 2:
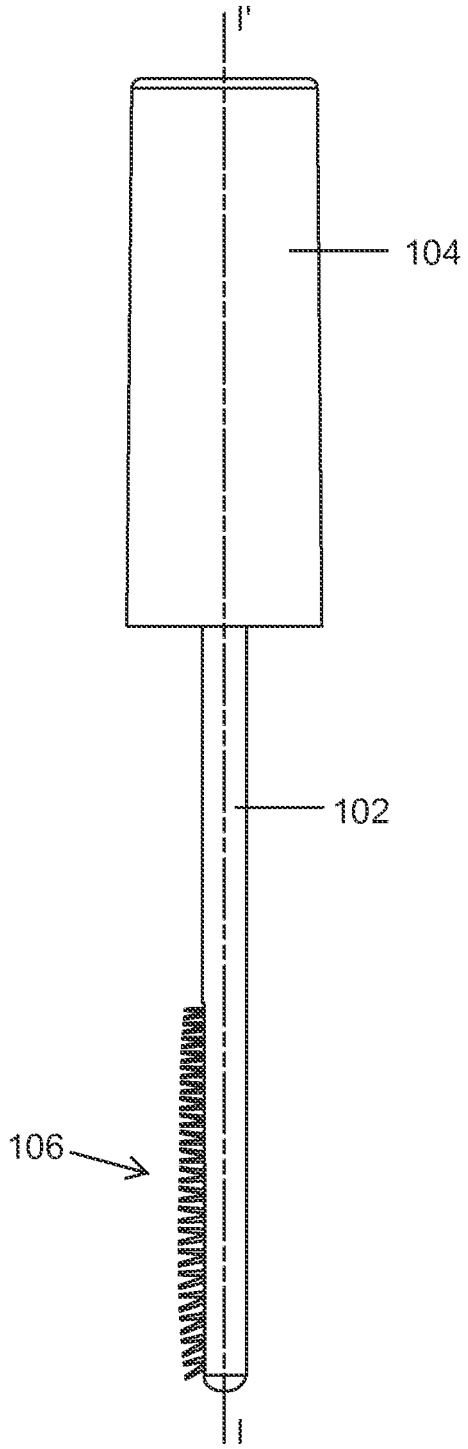
FIG. 2 illustrates a side view of the cosmetic applicator of FIG. 1.
Figure 10A:
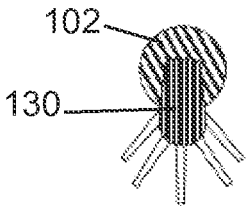
FIG. 10A-10B illustrate cross-sectional views of a cosmetic applicator according to an alternate embodiment.
Figure 10B:
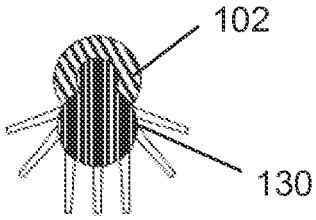

In an exemplary embodiment, the application member (106) is inserted such that the applicator head (130) fits into the channel (120) of the longitudinal opening (118) with the tines (136) projecting out therefrom. The cap (132) abuts the distal end (110) of the stem (102) to fit the application member (106) into the stem (102). As shown in FIGS. 1 to 2, the base member (124) and the applicator head (130) are completely contained within the stem (102) whereas only the tines (136) project out from one side of the stem (102). Therefore, the stem (102) acts as a core to which the tines (136) may be attached for the cosmetic applicator (100). However, in alternate embodiments as shown in FIGS. 10A and 10B, both the tines (136) and a portion of applicator head (130) may project out from the longitudinal opening (118) of the stem (102). Further, the ribs (134) on the applicator head (130) align with the grooves (122) of the stem (102) to snap fit the two together. It may be contemplated, that the fitment of the application member (106) into the stem (102) by snap fit locking mechanism is merely exemplary, and is not to be construed in a limiting manner.

As explained previously, the application member (106) and more specifically, the applicator head (130) is flexible, therefore when the applicator head (130) is constrained within the channel (120) of the longitudinal opening (118), the applicator head (130) adapts the shape of the longitudinal opening (118). In an exemplary embodiment of the present disclosure, the stem (102) and the longitudinal opening (118) have substantially straight shape and profile, therefore, when the applicator head (130) fits into the longitudinal opening (118), then the applicator head (130) also adapts a substantially straight shape and profile.

Further, as the applicator head (130) adapts the substantially straight shape as that of the stem (102), the distance between the free ends of the tines (136) is reduced. Therefore, the reduced distance between the free ends of the tines (136) creates a better grip of the eyelashes to provide an improved application of the mascara and provide a curling effect without expert manipulation of the cosmetic applicator (100).

Figure 8A:
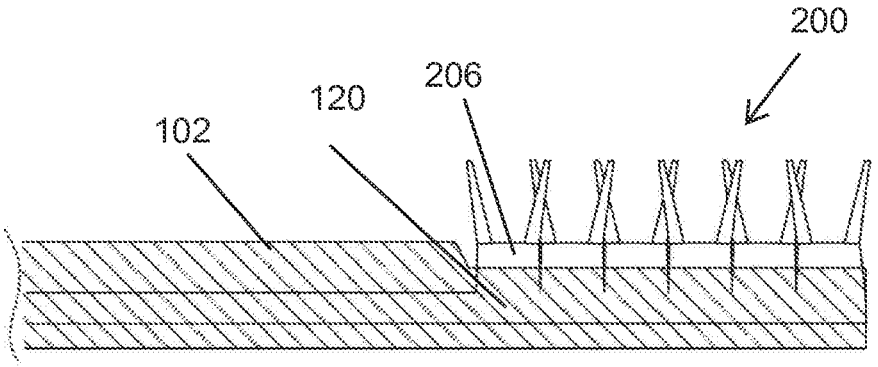
FIG. 8A illustrates a cosmetic applicator according to a second embodiment of the present disclosure.
Figure 8B:
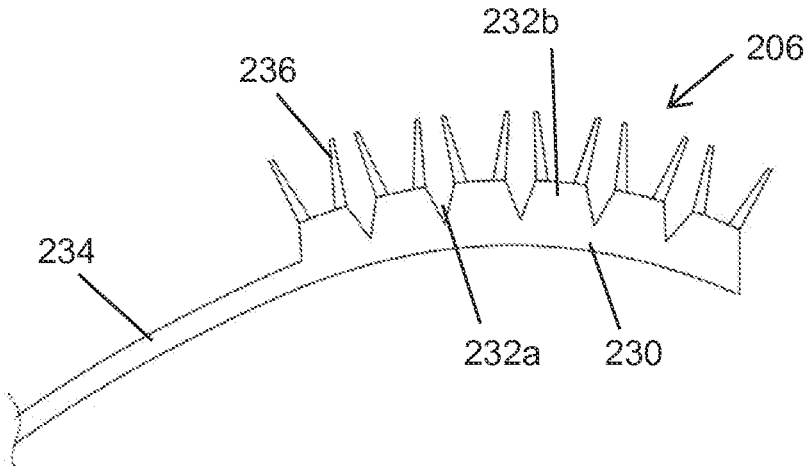
FIG. 8B illustrates a side view of a portion of an application member of the cosmetic applicator of FIG. 8A.
Figure 8C:
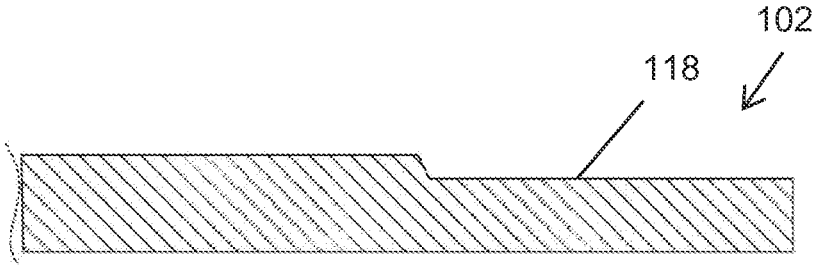
FIG. 8C illustrates a side view of a portion of a stem of the cosmetic applicator of FIG. 8A.

FIGS. 8A-8C illustrates a cosmetic applicator (200), a side view of a portion of an application member (206) of the cosmetic applicator (200) and a side view of a portion of a stem (102) of the cosmetic applicator (200) respectively, according to a second embodiment of the present disclosure. The cosmetic applicator (200) resembles the cosmetic applicator (100) except in that the applicator head (230) of the cosmetic applicator (200) differs in its structural configuration. The cosmetic applicator (200) comprises a stem (102) and an application member (206). Further, the application member (206) includes a base member (234) and an applicator head (230) which is curved in shape. The applicator head (230) includes one or more grooves (232*a*) that extend in a width wise direction of the applicator head (230) and wherein the grooves (232*a*) act as hinges which enable the applicator head (230) to deform easily. According to the present embodiment, the plurality of grooves (232*a*) is present on the applicator head (230) such that the grooves (232*a*) divide the applicator head (230) in to a plurality of portions (232*b*). The applicator head (230) further includes tines (236) extending from a convex side of the applicator head (230). The tines (236) project from the portions (232*b*) and are not present in the grooves (232*a*). During assembly, when the application member (206) is inserted into the channel (120) of the stem (102), the applicator head (230) being flexible deforms and conforms to a substantially straight shape of the channel (120) and the tines (236) project out from a longitudinal opening (118). As the applicator head (230) adapts the substantially straight shape, the distance between the free ends of the tines (236) is reduced as the portions (232*b*) move relatively closer to one another by pivoting about grooves in axes perpendicular to a longitudinal axis of the stem (102)/applicator head (230). More specifically, in the present embodiment, the free ends of the tines (236) present on one of the portions (232*b*) overlap with the tines (236) of the neighboring portion (232*b*) when the applicator head (230) is constrained within the channel (120) of the longitudinal opening (118).

Figure 9A:
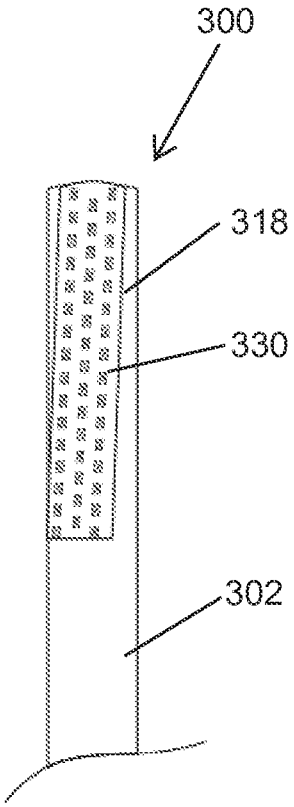
FIG. 9A illustrates a front view of a cosmetic applicator according to a third embodiment of the present disclosure.
Figure 9B:
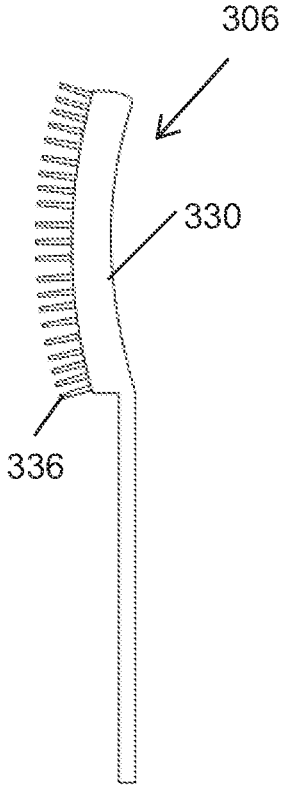
FIGS. 9B-9C illustrate a side view and a front view respectively of an application member of the cosmetic applicator of FIG. 9A.
Figure 9C:
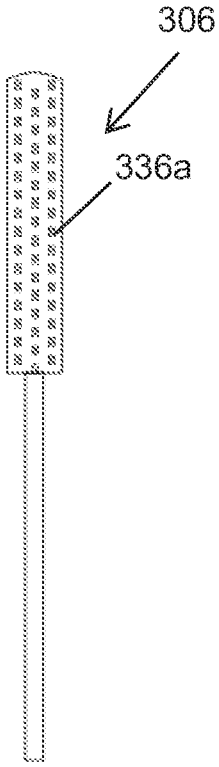

FIG. 9A illustrates a front view of a cosmetic applicator (300) according to a third embodiment of the present disclosure and FIGS. 9B-9C illustrate a side view and a front view of an application member (306) of the cosmetic applicator (300) according to the third embodiment of the present disclosure. The cosmetic applicator (300) resembles the cosmetic applicator (100) except in that the stem (302) of the cosmetic applicator (300) has a longitudinal opening (318) which extend at an angle or inclined with respect to a longitudinal axis of the cosmetic applicator (300). The application member (306) has a curved applicator head (330) having a concave and a convex side and wherein a plurality of tines (336) extend from the convex side. The tines (336) are arranged in rows (336*a*) which extend in longitudinal direction of the application member (330). When the curved applicator head (330) is constrained within the channel (not visible) of the stem (302), the applicator head (330) being flexible deforms to adapt a straight configuration and the rows (336*a*) of tines (336) projecting out from the longitudinal opening (318) extend substantially at the same inclined angle as that of the longitudinal opening (318).

Figure 11A:
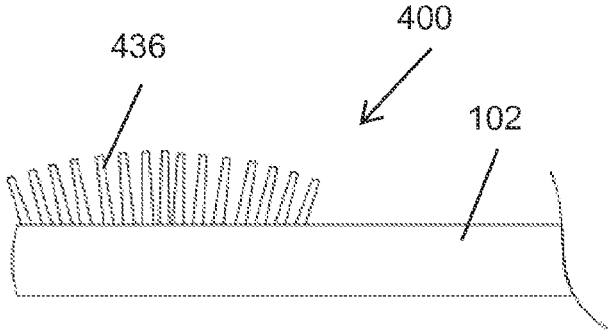
FIG. 11A illustrates a side view of a cosmetic applicator according to a fourth embodiment of the present disclosure.
Figure 11B:
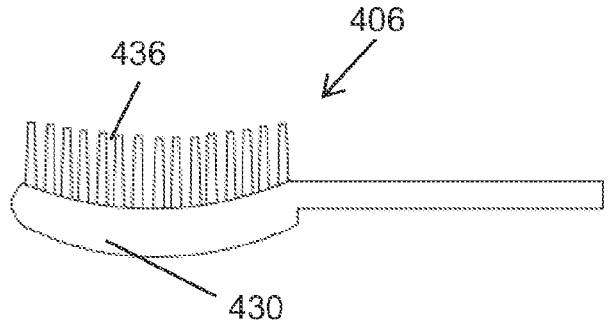
FIG. 11B illustrates a side view of an application member of the cosmetic applicator of FIG. 11A.

FIG. 11A illustrates a side view of a cosmetic applicator (400) and FIG. 11B illustrates a side view of an application member (406) of the cosmetic applicator (400) according to a fourth embodiment of the present disclosure. The cosmetic applicator (400) resembles the cosmetic applicator (100) except in that the tines (436) of the cosmetic applicator (400) extend from a concave side of an applicator head (430). A face of the application head (430) formed by joining free ends of the tines (436) conforms to the concave curvature of the concave side of the applicator head (430). As shown in the FIG. 11A when the application member (406) is fitted in to a channel (not visible) of the stem (102), the applicator head (430) deforms and conforms to a shape of the channel of the stem (102) which is substantially straight. As a result of this deformation in the curvature of the application head (430) the distance between free ends of the tines (436) is increased i.e. the tines (436) fan out.

Figure 12B:
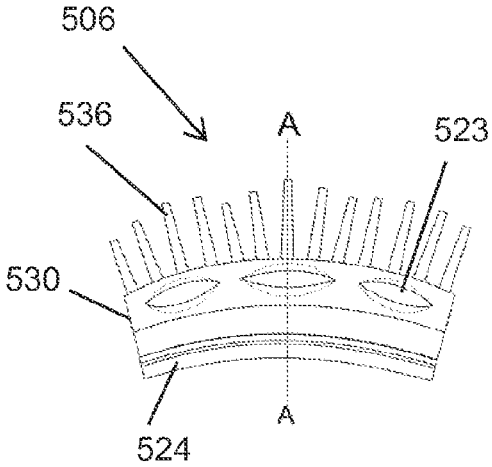
FIG. 12B illustrates a side view of an application member of the cosmetic applicator of FIG. 12A.
Figure 12A:
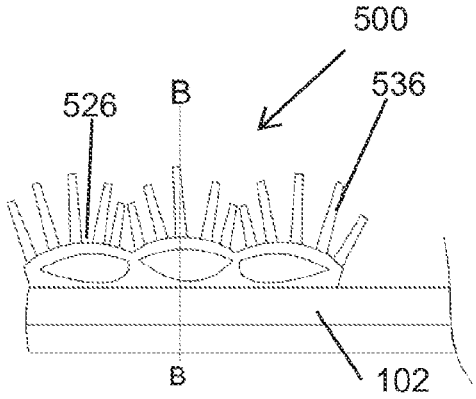
FIG. 12A illustrates a side view of a cosmetic applicator according to a fifth embodiment of the present disclosure.
Figure 13B:
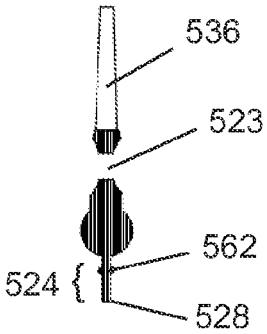
FIG. 13B illustrates a cross-sectional view along axis A-A of FIG. 12B.
Figure 13A:
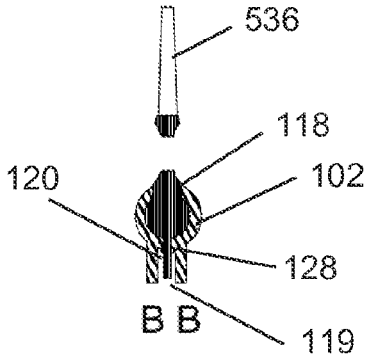
FIG. 13A illustrates a cross-sectional view along axis B-B of FIG. 12A.

FIG. 12A illustrates a side view of a cosmetic applicator (500) and FIG. 12B illustrates a side view of an application member (506) according to a fifth embodiment of the present disclosure. The application member (506) as shown in FIG. 12B, has a curved applicator head (530) and a base member (524) extending from the curved applicator head (530). A plurality of tines (536) extends from a convex side of the curved applicator head (530) and the base member (524) is joined at the concave side of the curved applicator head (530). The applicator head (530) further includes a plurality of thorough holes (523) extending in width wise direction of the applicator head (530). The pluralities of holes (523) are present at a regular interval in the applicator head (530). However, in an alternative embodiment, the pluralities of holes (523) may extend in a length wise direction of the applicator head (530). Referring now to FIGS. 12A, 13A and 13B, the stem (102) has another longitudinal opening (119) opposite a longitudinal opening (118). Therefore, for assembling the cosmetic applicator (500), the application member (506) is inserted into a channel (120) of the stem (102) and an assembling person may pull an end (528) of base member (524) from the longitudinal opening (119) to snap fit the application member (506) into the stem (102) i.e. the application member (506) is pulled in a direction perpendicular to a longitudinal axis of the applicator (500). The base member (524) includes the ribs (562) which fit within corresponding grooves (128) of the stem (102) to snap fit the two together. It may be contemplated, that the fitment of the application member (506) into the stem (102) by snap fit locking mechanism is merely exemplary, and is not to be construed in a limiting manner.

Further, as shown in FIGS. 12A, 13A and 13B, when the application member (506) is inserted into a longitudinal opening (118) of the stem (102), the applicator head (530) fits into the channel (120) of the stem and, the tines (536) and a portion of applicator head (530) project out from the longitudinal opening (118) of the stem. Further, as a result of this fitment, the shape of the thorough holes (523) changes, resulting in uneven deformation in the curvature of the application head (530) and because of the uneven deformation of different portions of the applicator head (530) during the fitment, a plurality of bulged out/curved portions (526) are formed at the side which was formerly convex. As a result of this deformation of the application head (530) and formation of the plurality of bulged out/curved portions (526) the distance between free ends of the some of the tines (536) is increased and the distance between free ends of the some of the tines (536) is decreased.

Figure 14:
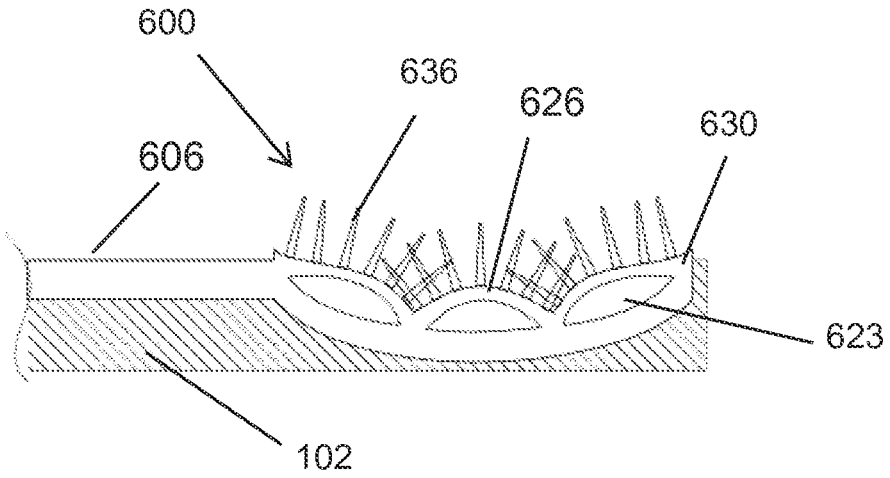
FIG. 14 illustrates a partial cross-sectional view of a portion of a cosmetic applicator according to a sixth embodiment of the present disclosure.

FIG. 14 illustrates a cosmetic applicator (600) according to a sixth embodiment of the present disclosure. The cosmetic applicator (600) resembles the cosmetic applicator (500) except in that tines (636) of the cosmetic applicator (600) are present on the concave side (not shown) of an applicator head (630). The applicator head (630) further includes a plurality of thorough holes (623) extending in width wise direction of the applicator head (630). When the application member (606) of the present embodiment is inserted within a channel (not shown) of the stem (102), the concave side of the application head (630) deforms resulting in formation of bulged out portions (626). As a result of this deformation of the application head (630) and formation of bulged out portions (626), the distance between free ends of the some of the tines (636) is increased and the distance between free ends of the some of the tines (636) is decreased.

Although the foregoing is directed to embodiments of the present disclosure, other and further embodiments of the disclosure may be devised without departing from the basic scope thereof, and the scope thereof is determined by the claims that follow. Accordingly, the appended claims should be construed to encompass not only those forms and embodiments of the disclosure specifically described above, but to such other forms and embodiments as may be devised by those skilled in the art without departing from its true spirit and scope.

What is claimed is:

1. A cosmetic applicator comprising:

a stem having a hollow elongated body; the stem having a distal end and a proximal end;

a handle attached to the proximal end of the stem;

an application member attached to the distal end of the stem, the application member comprises an elongated base member and an applicator head attached at a first end of the elongated base member;

wherein the stem has a longitudinal opening at the distal end;

wherein the applicator head is flexible and has a first shape;

wherein the applicator head is configured to attain a second shape when the applicator head is constrained within a channel of the longitudinal opening of the stem;

wherein the applicator head includes a plurality of projecting elements for holding and discharging a cosmetic product;

wherein a predetermined distance is maintained between free ends of the plurality of projecting elements in the first shape of the applicator head; and wherein the predetermined distance between free ends of at least two of the plurality of projecting elements is reduced when the applicator head fits into the channel of the longitudinal opening of the stem.

2. A cosmetic applicator according to claim 1, wherein the application head is curved in the first shape and is straight in the second shape.

3. A cosmetic applicator according to claim 1, wherein the longitudinal opening is disposed on one side of the stem.

4. A cosmetic applicator according to claim 1, wherein the plurality of projecting elements is selected from a group of tines, bristles and flocking.

5. A cosmetic applicator according to claim 1, wherein the plurality of projecting elements includes tines that are hook shaped.

6. A cosmetic applicator according to claim 1, wherein the plurality of projecting elements is disposed only on one side of the applicator head and wherein the plurality of projecting elements projects out from the longitudinal opening of the stem when the application member is fitted into the stem.

7. A cosmetic applicator according to claim 1, wherein the applicator head comprises one or more grooves that extend in a width wise direction of the applicator head and wherein the grooves act as hinges enabling the applicator head to deform easily.

8. A cosmetic applicator according to claim 1, wherein the longitudinal opening extend at an angle with respect to a longitudinal axis of the cosmetic applicator.

9. A cosmetic applicator according to claim 1, wherein the applicator head includes a plurality of through holes extending in width wise direction of the applicator head.

10. A cosmetic applicator according to claim 1, wherein the plurality of projecting elements extends from a convex or a concave side of the applicator head.

11. A cosmetic applicator according to claim 1, wherein the stem includes a number of grooves on an inner surface at the distal end of the stem and wherein the applicator head includes a number of ribs; and wherein the number of ribs are configured to align with the number of grooves to lock the applicator head and the application member within the stem.

12. A cosmetic applicator according to claim 1, wherein a height of the applicator head is substantially equal to a length of the longitudinal opening of the stem.

13. A cosmetic applicator according to claim 1, wherein the applicator head has a larger outer diameter than an outer diameter of the base member.

14. A cosmetic applicator according to claim 1, wherein a cap is provided at a tip of the applicator head and a cross section of the cap is similar to a cross-section of the stem.

15. A cosmetic applicator according to claim 1, wherein the predetermined distance between the free ends of the plurality of projecting elements is based on one or more parameters selected from a group of parameters including material, thickness and desirable density of the plurality of projecting elements.

16. A cosmetic applicator comprising:

a hollow stem, the hollow stem having a distal end and a proximal end;

a handle attached to the proximal end of the hollow stem;

an application member attached to the distal end of the hollow stem, the application member comprises an elongated base member and an applicator head attached at a first end of the elongated base member;

wherein the hollow stem has a longitudinal opening at its distal end;

wherein the applicator head is flexible and has a first shape;

wherein the applicator head is configured to attain a second shape when the applicator head is constrained within a channel of the longitudinal opening of the hollow stem; and wherein a length of the application member is greater than a length of the hollow stem.

17. A cosmetic applicator according to claim 16, wherein the applicator head is curved in the first shape and is straight in the second shape.

18. A cosmetic applicator according to claim 16, wherein to fit the application member within the hollow stem, a second end of the elongated base member is inserted into the hollow stem from an opening at the distal end of the hollow stem and the elongated base member is then pulled through an opening at the proximal end of the hollow stem such that the applicator head fits inside the hollow stem and a portion of the applicator head projects out from the longitudinal opening of the hollow stem.

19. A cosmetic applicator comprising:

a hollow stem; the hollow stem having a distal end and a proximal end;

a handle attached at the proximal end of the hollow stem;

an application member attached at the distal end of the hollow stem, the application member comprises an elongated base member and an applicator head attached at a first end of the elongated base member;

wherein the hollow stem has a longitudinal opening at the distal end;

wherein the applicator head is flexible and has a curved shape;

wherein the applicator head includes at least one concave side and at least one convex side;

wherein a plurality of projecting elements for holding and discharging a cosmetic product is present on either the at least one concave side or the at least one convex side;

wherein the at least one concave side or the at least one convex side having the plurality of projecting elements deforms resulting in formation of a plurality of curved portions, when the applicator head is constrained within a channel of the longitudinal opening of the hollow stem.

20. A cosmetic applicator according to claim 19, wherein a predetermined distance between free ends of at least two of the plurality of projecting elements changes when the applicator head fits into the channel of the longitudinal opening of the hollow stem.

* * * * *